US005768809A

United States Patent [19]

Savoie

[11] Patent Number: 5,768,809

[45] Date of Patent: Jun. 23, 1998

[54] QUICK-RELEASE SPIKE FOR FOOTWEAR

[75] Inventor: Armand J. Savoie, Gardner, Mass.

[73] Assignee: Macneill Engineering Company, Inc., Marlborough, Mass.

[21] Appl. No.: 774,585

[22] Filed: Dec. 23, 1996

Related U.S. Application Data

[60] Provisional application No. 60/010,099.

[51] Int. Cl.[6] ..... A43C 15/16; A43C 15/02

[52] U.S. Cl. ..... 36/134; 36/114; 36/67 A; 36/67 D; 36/127

[58] Field of Search ..... 36/134, 116, 114, 36/67 R, 67 A, 67 D, 62, 66, 59 R, 126, 127, 128, 129, 131

[56] References Cited

U.S. PATENT DOCUMENTS

| | | | |
|---|---|---|---|
| 1,758,408 | 5/1930 | Pierce et al. | 36/67 D |
| 2,026,280 | 12/1935 | Kerin | 36/59 R |
| 3,267,593 | 8/1966 | Turner | 36/59 |
| 3,731,406 | 5/1973 | Young | 36/67 D |
| 4,035,934 | 7/1977 | Hrivnak | 36/67 |
| 4,414,763 | 11/1983 | Bente | 36/134 |
| 4,445,288 | 5/1984 | Fror | 36/134 |
| 4,492,047 | 1/1985 | Arff | 36/134 |
| 4,633,600 | 1/1987 | Dassler et al. | 36/134 |
| 4,698,923 | 10/1987 | Arff | 36/128 |
| 4,723,366 | 2/1988 | Hagger | 36/134 |
| 5,036,606 | 8/1991 | Erich et al. | 36/134 |
| 5,321,901 | 6/1994 | Kelly | 36/134 |
| 5,475,937 | 12/1995 | Korsen | 36/134 |
| 5,628,129 | 5/1997 | Kilgore et al. | 36/134 |

FOREIGN PATENT DOCUMENTS

| | | | |
|---|---|---|---|
| 48310 | 10/1983 | European Pat. Off. | 36/134 |
| 0 360 202 | 3/1990 | European Pat. Off. . | |
| 25 43 268 | 3/1977 | Germany . | |
| 31 34 817 | 3/1983 | Germany . | |
| 3242606 | 8/1983 | Germany | 36/134 |
| 34 23 363 | 1/1986 | Germany . | |
| 320029 | 10/1929 | United Kingdom . | |

*Primary Examiner*—Paul T. Sewell
*Assistant Examiner*—Anthony Stashiek
*Attorney, Agent, or Firm*—Bromberg & Sunstein LLP

[57] ABSTRACT

A removably attachable traction gear for the underside of footwear having two primary components: a retaining member and a receptacle. These two components respectively replace the common screw and threaded receptacle systems found in for affixing traction gear to the underside of shoes. A partial turn of the traction gear securely locks the gear into the receptacle. The retaining member has a three-extension design so as to make the traction gear resistant to lateral forces applied to the ground-engaging end of the cleat. Locking is achieved through use of cantilevered fingers which press in during installation of the retaining member, and which spring back out to lock with mated indentations in the extensions. During installation a dome containing insole material is compressed. Unlocking is achieved through reverse turning the retaining member to force the springs back in, and removal is aided through re-expansion of the dome. In a preferred form, the invention is utilized to attach a golf cleat to a shoe.

37 Claims, 12 Drawing Sheets

QUICK-RELEASE SPIKE FOR FOOTWEAR

The present application claims priority from provisional application Ser. No. 60/010,099, filed Jan. 17, 1996, and titled "Quick-Release Spike for Footwear," which is incorporated herein by reference.

1. Field of the Invention

This invention relates to the mounting of traction gear on the bottom of footwear, in particular, athletic footwear.

2. Background Art

Conventional traction gear presently in use employ an attachment means consisting of screwing the traction gear into the mated receiving receptacle in the bottom of the footwear. Using this screw-type attachment method is especially laborious when one takes into account that a typical golf shoe, for instance, has eleven cleats; as a result, replacing the cleats on a pair of golf shoes entails unscrewing twenty-two cleats and screwing on twenty-two cleats, where each act of unscrewing or screwing entails several turns, typically two and one-half times, for each cleat.

An example of a typical prior-art cleat is in U.S. Pat. No. 4,723,366 (hereinafter the '366 cleat), which patent is incorporated herein by reference. This patent describes a cleat which includes a metal stud infrastructure at the core of the cleat, the infrastructure having a vertical axis and two ends, a screw portion at a first end for engagement with a receptacle within a shoe, a ground end for tractive engagement with the ground, and a broad flange between the screw and head portions and extending radially outward from the vertical axis; a plastic skirt is molded directly upon the flange portion to form a unitary reinforced radial support member of the cleat. Installation of the '366 cleat consists of screwing it into a mated receptacle in the bottom of athletic footwear.

Although some prior-art references show cleat-attachment systems that require less than a full turn, or they require a snap-on arrangement to lock the cleat in place, it appears none of these systems have found wide acceptance amongst users because of shortcomings in stability, ease-of-use, receptacle size and ease-of-manufacture. For instance, in U.S. Pat. No. 4,633,600 to Dassler, a cleat attachment system is disclosed in which a snap ring socket is utilized to affix a cleat to the bottom of a shoe.

In U.S. Pat. No. 3,267,593 to Turner, a cleat attachment system is disclosed wherein the top of the cleat spike has two extensions forming a rough T-shape out of the spike, where the spike is inserted into a mated receptacle having two grooves to receive the extensions. Upon complete insertion of the spike into a receptacle, the spike is turned until the extensions drop into receiving grooves at the top of the receptacle; a retaining ring is then slid onto the mid-section of the spike, this ring apparently preventing the spike from unseating the extensions from the grooves.

Similarly, in German Patent Application Nos. DE3134817A1 to Sportartikelfabrik Karl Uhl GmbH, and DE3423363A1 to Gebrider Goldschmidt Baubeschlaige GmbH, another T-spike design is disclosed in which internal to the mated receptacle are ramping means for engaging and retaining the spike extensions. In the former, a rough interior surface catches the extensions, while in the latter, a sloping interior engages the extensions.

U.S. Pat. No. 4,492,047 to Arff, discloses another T-shape spike in which the skirt is deformed during insertion. Insertion of the spike causes the extensions to go up a ramp and then down a ramp, pulling the spike into the receptacle, and leaving the extensions in a holding area. The skirt is deformed so as to result in a pressure against the socket, the pressure apparently holding the spike from accidentally traveling back up the ramp towards removal.

In U.S. Pat. No. 4,035,934 to Hrivnak, another T-shape spike is disclosed in which the spike column has two indentations. During installation, two spring arms, each positioned perpendicular to the surface of the shoe and parallel to the spike, are pressed in during insertion of the spike, and spring back out to press against the indentations upon complete insertion. Removal of this spike is achieved with a U-shaped tool which slides into the spike receptacle and pushes in the spring arms, thus freeing the spike for removal.

SUMMARY

The present invention provides a system for removably attaching traction gear to the underside of footwear. This system includes two primary components: a retaining member and a receptacle. In a preferred embodiment of the invention, these two components respectively replace the common screw and threaded receptacle system for affixing traction gear to the underside of shoes, providing a faster and simpler attachment of the cleat. Only a partial turn of about 60 degrees of the traction gear securely locks the gear into the receptacle. The three-extension design of a preferred embodiment of the invention makes the traction gear resistant to lateral forces applied to the ground-engaging end of the cleat. Although a preferred embodiment of the invention is a skirted spike utilizing the attachment system for attachment to a golf shoe, other types of traction gear, such as that for rock climbing, may employ the same attachment system.

The present invention employs a three-extension quick-release system for attaching cleats to footwear, instead of the conventional the screw method, snap-ring, or T-shaped spike of prior-art cleats; with the quick-release system, one can place a cleat into a receptacle in the bottom of a shoe, and simply give the cleat a partial turn to lock it into place for use. (References herein and within the claims that follow to the "top" and "bottom" respectively refer to the end nearer the wearer's foot, and the end nearer the ground.)

A cleat according to the present invention includes a base, preferably made of metal and/or plastic, where at the bottom of the base is standard traction gear, such as the skirt and spike of a golf cleat, and at the top of the base is additional structure for attaching the traction gear to a shoe. The skirt may include full or partial apertures for receiving a cleat wrench, which may be used to install and remove the cleat. Attachment is achieved through use of several extensions projecting out from the top of the base at right angles to the base. In a preferred embodiment of the invention, three extensions are used, all of which are in the same plane, and if you were to turn a cleat using this invention upside down, i.e. ground tip up, it would appear that the cleat was standing on a roughly triangular base formed of the three extensions. To use the invention, an athletic shoe would contain receptacles in the bottom of the shoe designed to receive the new quick-release cleat. In the preferred embodiment, the shoe's receptacles would have openings roughly triangular in shape, so that installing a cleat is as simple as (i) plugging a cleat into a shoe receptacle, and (ii) giving the cleat less than a quarter-turn to lock it into place. Turning the cleat causes the tip of one of the extensions to slide over the edge of the receptacle opening, keeping the cleat from falling off; once turned, a locking mechanism inside the receptacle resists the cleat from turning back and falling off. In addition, to ensure a tight fit, and to help prevent dirt and grime from getting inside the receptacle, the extensions and receptacle are preferably designed so that as a cleat is turned within a receptacle, the space for the extension gets tighter, thus compressing the extensions during installation. In addition, located at the top of the receptacle is a resilient bubble partially filling the receptacle, this bubble has a certain resiliency or elasticity, such that the bubble is compressed during insertion of the cleat within the receptacle. When the cleat locks into place, the tight fit and use of three extensions within a receptacle, in addition to the downward pressure from the compressed bubble, renders the cleat very stable. Removal of the cleat is achieved by simply turning the cleat in the opposite direction of installation. The compressed bubble then aids removal of the cleat, and the expansion of the bubble during removal helps eject the spike from the receptacle. The preferred design of the locking mechanism is such that it takes much more force to turn against the lock than it took to install a cleat.

In a preferred embodiment, a cleat using this system is made out of plastic with internal metal reinforcement; an all-metal design, or a design using resin or another tough material, may be used. Some materials that may be used to form traction gear according to the present invention include but are not limited to thermoplastic materials such as Stanyl Nylon 46, Dupont Acetal Resin 100ST, Technyl A216, Noryl GTX 810, Noryl GTX 820, Polyurethane S74D, Polyurethane 90A, Nylon 6, Nylon 6/6, and Rython. In the present invention, use of such materials to form the extensions with a metal core in the base is preferred as this design allows for extensions that are actually bigger than the space for them inside the receptacle, so that installing a cleat compresses and squeezes the extensions so that a very tight fit results.

In preferred embodiments, a retaining member has three extensions that are inserted into a mated receptacle. Positioned on the top inner surface of the receptacle are ramps that hold the extensions within the receptacle, while also gradually compressing the extensions during installation of the retaining member. Preferred embodiments also include at least one cantilevered finger per extension, so that upon complete insertion of an extension, the tip of a cantilevered finger locks within a depression on the surface of the extension.

A preferred system for removably attachable traction gear for the underside of footwear comprises: (1) a retaining member having a vertical axis, (2) a bottom portion to which the traction gear is attached, and a top portion from which three extensions project, each extension having a sloped portion which is not perpendicular to the vertical axis in all directions, (3) a receptacle for receiving the retaining member, the receptacle having a top end and a bottom end, (4) a wall portion defining a cavity extending from the bottom end towards the top end, (5) a ledge portion attached to the bottom end and extending into the cavity, the ledge portion being positioned so as to hold the plurality of extensions within the cavity, and (6) three cantilevered fingers shaped and mounted within the cavity so as to engage the extensions of the retaining member and to resist dislodgment of the retaining member once the retaining member is installed.

BRIEF DESCRIPTION OF THE DRAWINGS

The following drawings are intended to provide a better understanding of the present invention, but in no way intended to limit the scope of the invention.

DESCRIPTION OF A PREFERRED EMBODIMENT OF THE INVENTION

Figure 1:
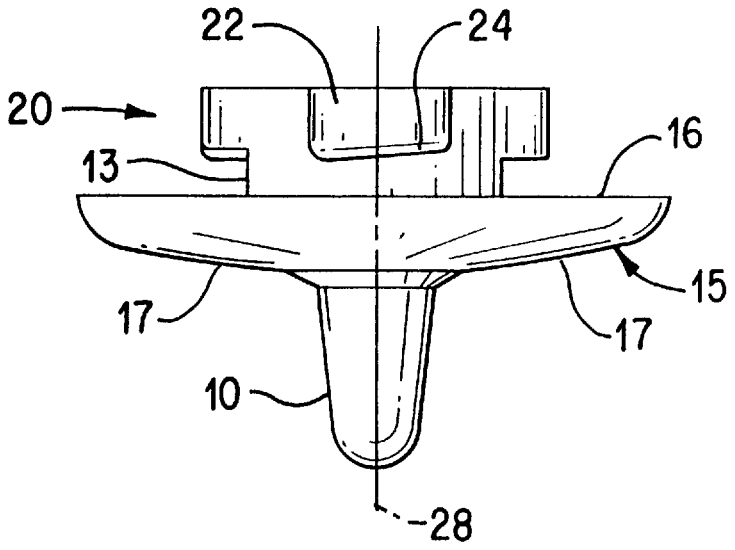
FIG. 1 is a view of a cleat according to one embodiment of the invention.

The invention comprises a system for allowing the quick attachment and release of a wide variety of traction gear. FIG. 1 shows that in one embodiment of the invention, the attachment system would be used to attach cleats, such as those disclosed in U.S. Pat. No. 4,723,366, to the underside of athletic footwear, a cleat installed in the bottom of a shoe using the present invention, when viewed from the bottom, has a similar appearance to the preferred embodiment of the invention disclosed herein. Evident in FIG. 1 are the bottom side 17 and top side 16 of the plastic skirt 15, the ground-engaging head portion 10 of the cleat, a base 13 to which the plastic skirt and ground-engaging portion are attached and a retaining member 20, which in this case is a base 13 with three rounded extensions 22, all of which are positioned around a central axis 28. In a preferred embodiment of the invention, the top 16 of the skirt 15 is slightly concave, and the bottom 17 of the skirt 15 is somewhat convex.

Figure 2:
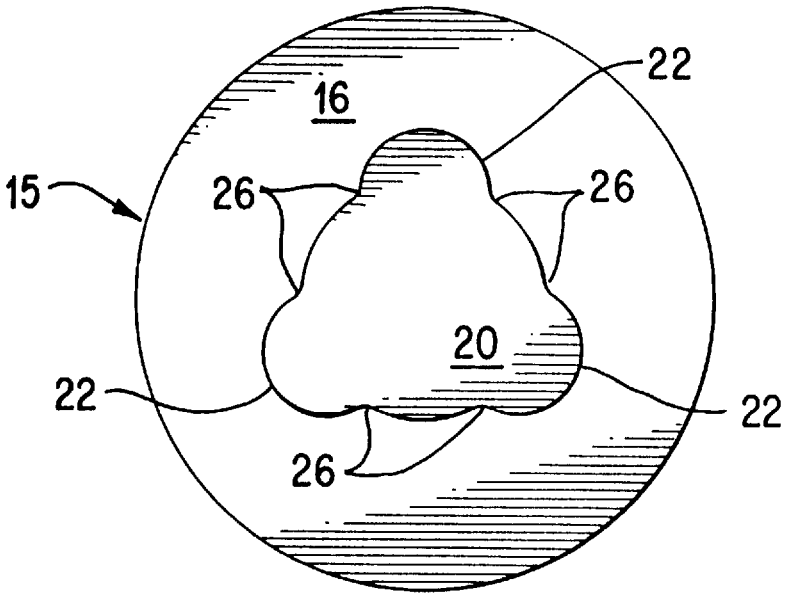
FIG. 2 a top view of the cleat of FIG. 1, showing the shape of the lobes to be inserted into a mated receptacle in the bottom of athletic footwear.
Figure 5:
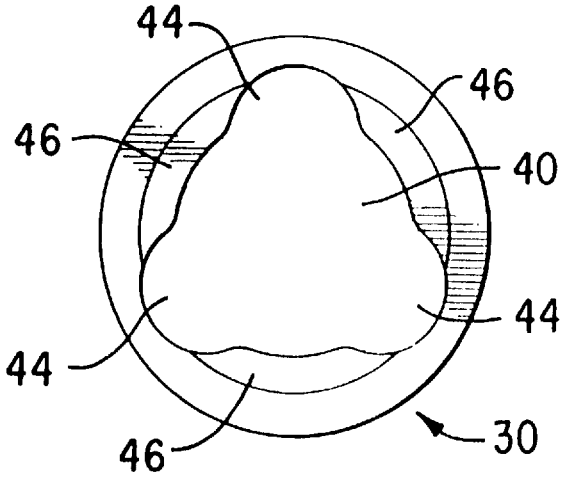
FIG. 5 is a bottom view of a receptacle that may receive the FIG. 1 cleat.
Figure 6:
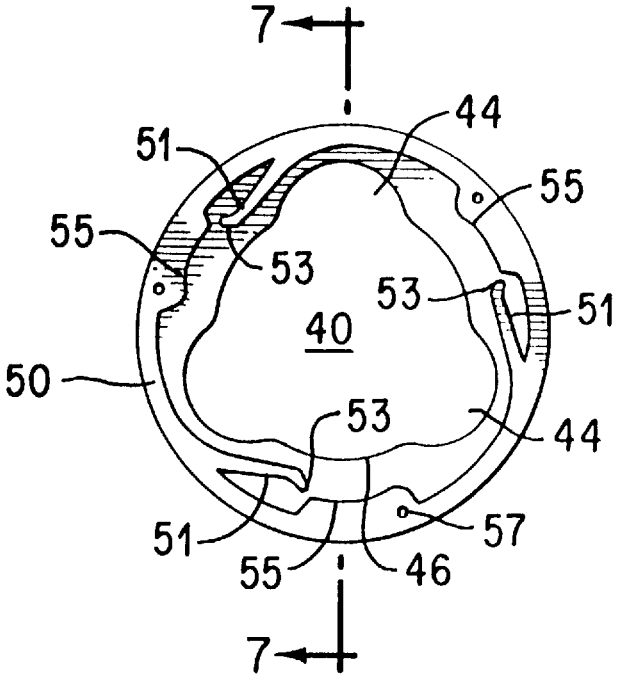
FIG. 6 is a top section view of the FIG. 5 receptacle wherein the top layer of the receptacle has been removed.

FIG. 2 shows the topside 16 of the cleat skirt 15 and the retaining member 20, which has a roughly triangular shape with indentations 26. The extensions 22 of the retaining member 20 are used in conjunction with components inside the receptacle, shown as item 30 in FIG. 5, for locking in place a properly inserted retaining member 20. Locking in place occurs after inserting the retaining member 20 into a mated receptacle opening 40 as shown in FIG. 5 and FIG. 6, and torquing the retaining member. The extensions 22 are attached to the base 13 (shown in FIG. 1), and together the extensions and the base form the retaining member 20. In a preferred embodiment of the invention, a completed cleat, comprising the retaining member 20 and traction gear, is made out of plastic with a metal core used to reinforce the structure. Although the invention could be made entirely out of metal, it is preferable that the cleat be made partially of plastic and partially of metal. When the retaining member is plastic, the retaining member may be integrally formed with a plastic skirt of a golf cleat with a core, preferably metal, extending through the retaining member and the traction gear to form the ground-engaging head portion 10 shown in FIG. 1.

In a preferred embodiment of the invention, upon insertion of the retaining member 20 into a receptacle, the angled surface 24 (shown in FIG. 1) of the extensions 22 allows for a tighter fit of the retaining member 20 into the receptacle 40 (shown in FIG. 5). The tight connection not only serves to give a stable connection between the shoe and traction gear, but also serves to keep moisture and debris out of the attachment system.

Figure 3:
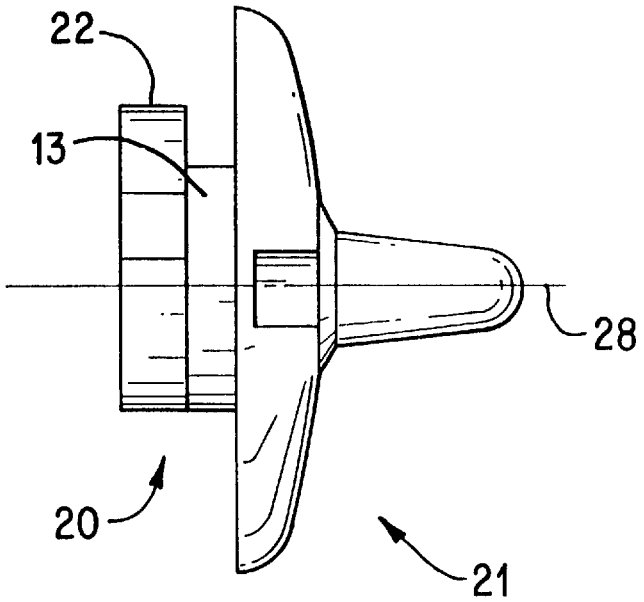
FIG. 3 another side view of the cleat of FIG. 1.

FIG. 3 is another view showing the structure and proportion of the retaining member 20 as attached to traction gear 21. FIGS. 2 and 3 show that in a preferred embodiment of the invention, the extensions 22 form a broad retaining member 20, and the base 13 is cylindrical and concentrically disposed around the center axis 28; the base 13 is attached to the extensions 22 and the traction gear 21.

Figure 4:
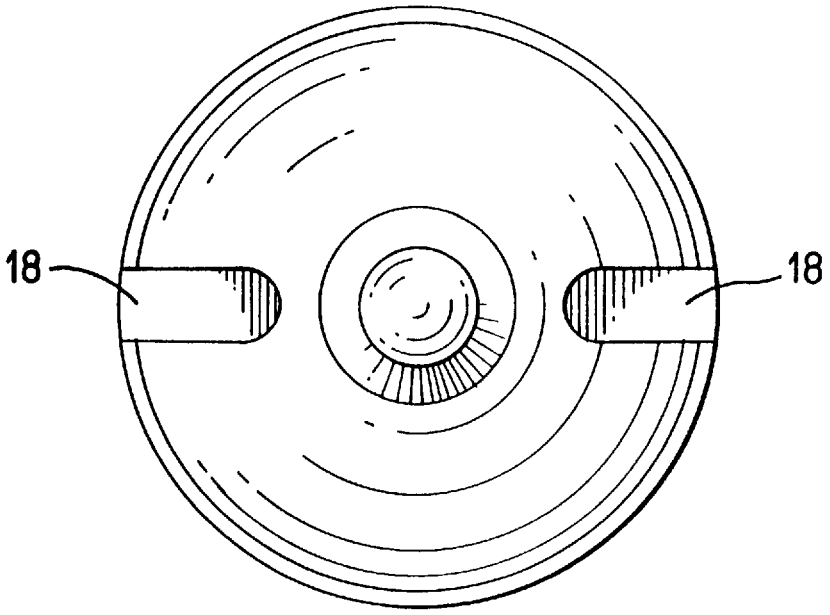
FIG. 4 is a bottom view of the cleat of FIG. 1.

FIG. 4, a bottom view of the FIG. 1 cleat, shows that, in a preferred embodiment of the invention, cleats do not have to be redesigned beyond modifying the retaining member 20 (shown in FIG. 1), and that conventional cleat designs are intended to be used in conjunction with the new retaining member; once a cleat is installed, the change in the retaining system is not apparent. A standard golf-cleat wrench may be used to engage the traction gear through use of the wrench holes 18.

FIG. 5 is a bottom view of a receptacle 30 that may receive the FIG. 1 cleat, showing the receptacle opening 40, with indentations 44 along its perimeter for accepting the retaining member extensions 22 (shown in FIG. 1). FIG. 5 also shows the ledges 46 that while serving to form the shape of the opening 40, also serve to hold the extensions 22 within the receptacle. Although preferred embodiments of the invention include a single receptacle opening 40, alternate embodiments of the system could have a receptacle with separate openings for receiving extensions.

FIG. 6 is a section view of FIG. 5 where the top layer of the receptacle has been removed to show the inner-cavity structure for receiving the retaining member 20 (shown in FIG. 1). Within the cavity, formed by wall portion 50, there are several cantilevered fingers 51, or spring arms, that are designed to grip and hold an installed retaining member. When a retaining member is inserted into the indentations 44 and twisted, the twisting action causes a protruding edge of an extension 22 (shown in FIG. 1) to push into and bend the finger 51 to allow the extension to be turned past the location of the finger. Once the protruding edge of an extension passes the location of the finger, the finger springs back to nearly its original shape, so that surface 53 rests against the perimeter of the extension 22. This allows the cleat to be removed, but only by exerting sufficient force to bend the finger 51 away from the surface of the extension 22, an arrangement requiring much greater torque than that required during installation of the retraining member. In one embodiment, the fingers are elongated in shape, with surface 53 forming a curved tip to the finger. FIG. 6 also shows bumps 55 which serve as a means for preventing a retaining member from being turned too far. In a preferred embodiment, the cleat should not be turned more than about 60°. Coincident with the fingers 51 locking into place, the protruding edge of an extension is blocked from further movement by the bumps 55, and the entire retaining system is prevented from falling out of the receptacle by ledges 46. FIG. 6 also shows one method of attaching the receptacle to the underside of footwear by the use of mounting holes 57.

Spacing within the receptacle may be designed such that during installation of a cleat, the receptacle opening 40 in which the extension is turned gradually narrows to compress and securely hold the cleat in place. Preferably the spacing is consistent or more gradual than the angled surface, so that the angled surfaces 24 (shown in FIG. 1) of the extension 22 being pressed against the ledges 46 cause the fit to be tight. In addition, having three extensions parallel to the cleat skirt makes for a more secure base for a cleat.

Figure 7:
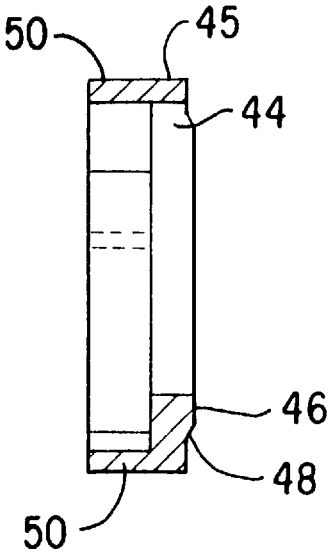
FIG. 7 is side vertical section of the receptacle of FIG. 6.

FIG. 7 is a vertical section of a portion of the embodiment of the receptacle of FIG. 6. This view shows the ledge 46 formed by the bottom layer 45 of the receptacle and the wall portion 50 that defines the cavity within the receptacle. This view also shows the slight rise 48 which forms a lip at the receptacle opening so that the edge of an installed cleat's skirt may overlay the lip. The lip helps hold the cleat in place and makes it more resistant to lateral forces while the cleat is in use.

Figure 8:
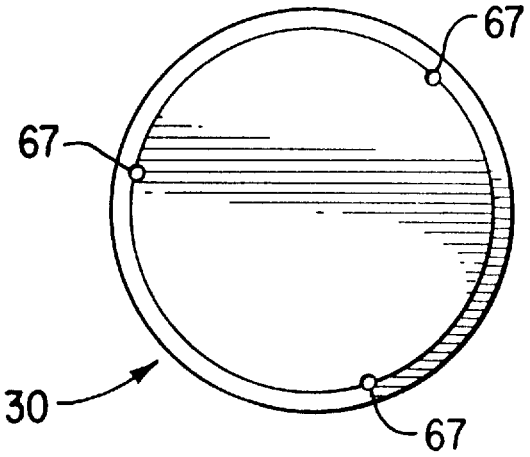
FIG. 8 is a top view of the FIG. 6 receptacle wherein the top layer has not been removed.

FIG. 8, which is the FIG. 6 receptacle where the top layer has not been removed, is a view from the top of the receptacle 30 in accordance with a preferred embodiment of the invention. This view shows the top side 67 of the mounting holes for attaching the receptacle.

Figure 9A:
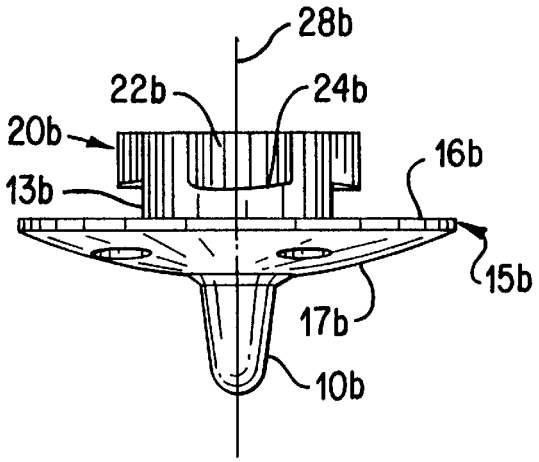
FIG. 9A is a perspective right side view of a cleat according to a preferred embodiment of the invention.
Figure 9B:
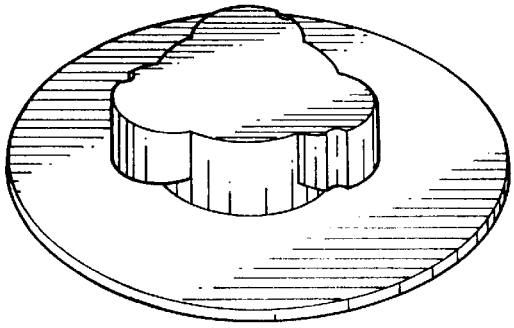
FIG. 9B is a perspective top view of the FIG. 9A cleat.
Figure 9C:
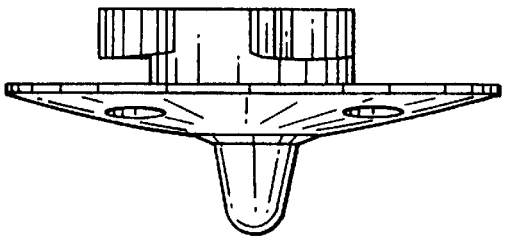
FIG. 9C is a perspective front view of the FIG. 9A cleat.
Figure 9D:
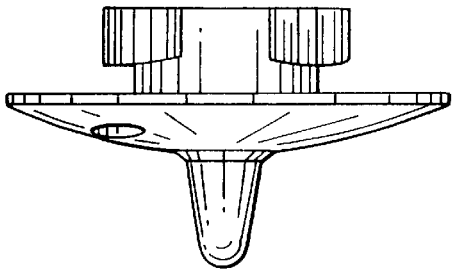
FIG. 9D a perspective left view of the FIG. 9A cleat.

FIGS. 9A–9D, 10 and 11 show a preferred embodiment of a cleat having the same basic characteristics and structural concerns of the FIGS. 1, 2, and 3 embodiments discussed hereinabove. Evident in FIG. 9A are the bottom side **17*b* and top side 16*b* of the plastic skirt 15*b*, the ground-engaging head portion 10*b* of the cleat, a base 13*b* to which the plastic skirt and ground-engaging portion are attached and a retaining member 20*b*, which in this case is a base 13*b* with three rounded extensions 22*b*, the extensions having an angled surface 24*b* and being positioned around a central axis 28*b*. FIGS. 9B–9D are respectively the perspective top, front, and left view of the FIG. 9A** cleat.

Figure 10:
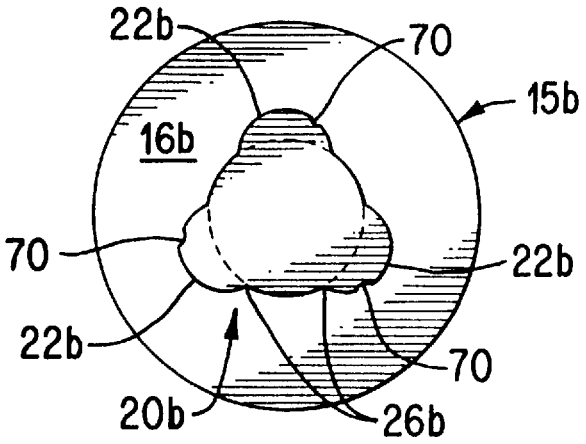
FIG. 10 is a top view of the cleat of FIG. 9A, showing the shape of the lobes to be inserted into a mated receptacle in the bottom of athletic footwear.

Evident in FIG. 10 are the corresponding topside **16*b* of the cleat skirt 15*b* and the retaining member 20*b*, with indentations 26*b*. The extensions 22*b* of the retaining member 20*b* are used in conjunction with components inside the receptacle 84 of FIG. 12A, for locking in place a properly inserted retaining member 20*b*. Locking in place occurs after inserting the retaining member 20*b* into a mated receptacle opening 40*b* shown in FIG. 12A, and torquing the retaining member. As with the FIG. 1 embodiment, upon inserting the retaining member 20*b* into a receptacle 84, the angled surface 24*b* (shown in FIG. 9A) of the extensions 22*b* forces a gradual compression of the retaining member 20*b* as it is inserted into the receptacle opening 40*b***, resulting in a tight connection giving stability while also serving to keep moisture and debris out of the attachment system.

Also evident in the FIG. 10 embodiment is a modification to the FIG. 2 embodiment, where the extensions 22 of FIG. 2 are modified to include an indentation 70 that further enhances the invention's resistivity to unlocking and its unintentional removal through normal use. Increased resistivity is effected by an interlocking of a cantilevered finger 74 (shown in FIG. 16) with the indentation 70. The cantilevered finger 74 corresponds to the cantilevered finger 51 of the FIG. 6 embodiment, in which the cantilevered finger 51 has been thickened to afford a greater resistivity to unintentional unlocking. Further, upon complete insertion of the retaining member 20*b* into an appropriate receptacle 84 (shown in FIG. 12A), the end portion 90 of the cantilevered finger 74 rests within the indentation 70. Consequently, removal of the cleat requires greater torque than that required to install the cleat.

Figure 11:
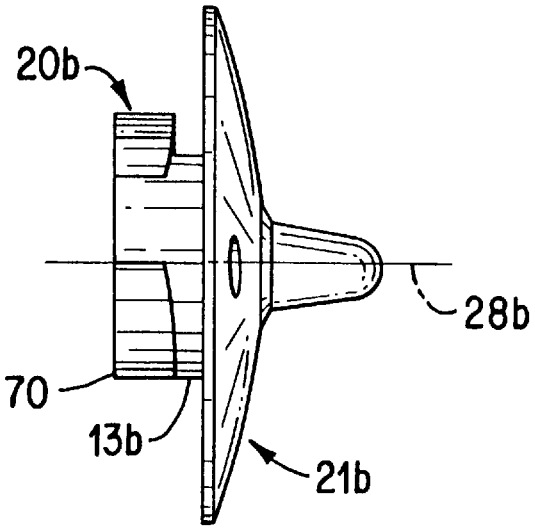
FIG. 11 is another side view of the cleat of FIG. 9A.

FIG. 11 is another view showing the structure and proportion of the retaining member 20*b* as attached to traction gear 21*b*, indicating the location of indentation 70, as well as showing that the placement of the retaining member 20*b* and base 13*b* is concentrically disposed around the center axis 28*b*.

Figure 12A:
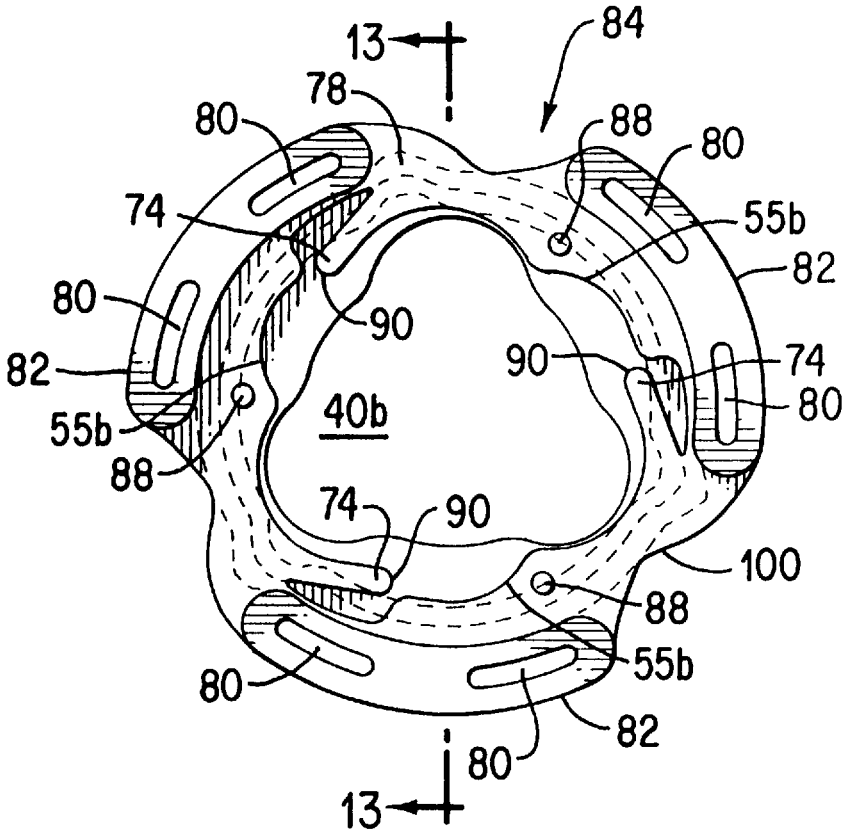
FIG. 12A is a top section view of a receptacle for receiving the cleat of FIG. 9A, wherein the top layer the receptacle has been removed.
Figure 12B:
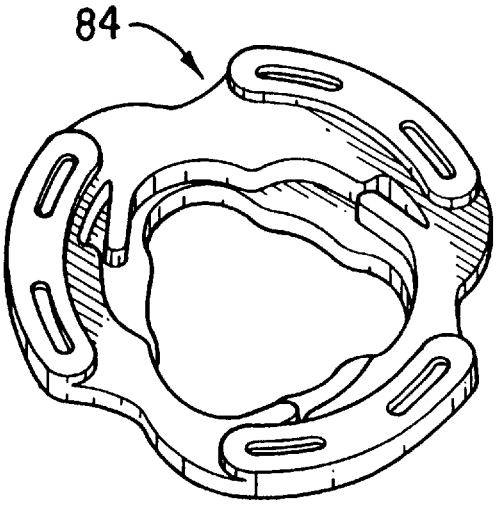
FIG. 12B a perspective bottom view of the FIG. 12A receptacle.

FIG. 12A is a section view of a preferred embodiment of a receptacle for receiving the cleat of FIGS. 9A–9D, 10 and 11, where the top layer of the receptacle 84 has been removed to show the inner-cavity structure for receiving the retaining member 20*b* (shown in FIG. 9A). FIG. 12B shows a perspective view of the FIG. 12A receptacle. As with the FIG. 6 embodiments, included within the cavity, formed by wall portion 78, are several cantilevered fingers 74 designed to grip and hold an installed retaining member 20*b*. When a retaining member is inserted and twisted, the twisting action causes a protruding edge of an extension 22*b* to push into and bend the finger 74 to allow the extension to be turned past the location of the finger. Once the protruding edge of an extension passes the location of the finger 74, the finger springs back to nearly its original shape, so that end portion 90 contacts the perimeter of the extension 22*b*. As described hereinabove, when the end portion 90 contacts extension 22*b*, there is an interlocking of cantilevered finger 74 with the indentation 70 (shown in FIG. 10). This allows the cleat to be removed, but only by exerting sufficient force to disengage and bend finger 74 away from indentation 70 and the surface of the extension 22*b*, an arrangement requiring much greater torque than that required during installation of the retaining member. As with the FIG. 6 embodiment, the fingers are preferably elongated in shape, end portion 90 forms a curved tip to the finger, and bumps 55*b* serve as a means for preventing a retaining member from being turned too far during insertion.

Also evident in the FIG. 12A receptacle is another preferred embodiment for attaching the receptacle 84 to the underside of footwear by the use of a mounting slot 80. In this embodiment, the perimeter 100 of the receptacle 84 comprises three flanges disposed around the receptacle opening 40*b*. In preferred embodiments, within each flange 82 of the perimeter are two slots 80 for mounting the receptacle 84 to footwear. Mounting of the receptacle is by methods known in the prior art, and may include forming sole material around the slots, or inserting a pin or other object through the slot to effectively nail the receptacle to an inner-sole of a shoe, and then forming the outer-sole material around the receptacle so affixed. The slots 80 are separated by a pre-determined distance and are preferably curved to conform to the curvature of the flange 82 in which the slot 80 is set. Also shown are three openings 88 to allow for attaching a receptacle cover 96 (shown in FIG. 14) to the receptacle 84.

Figure 13:
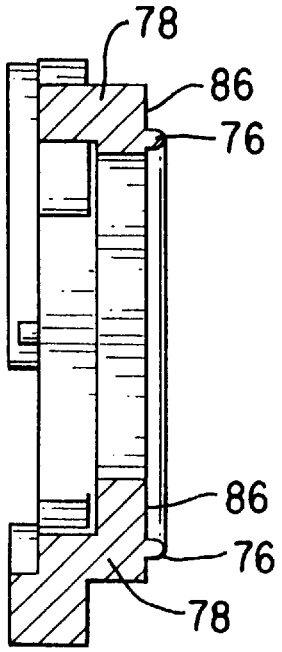
FIG. 13 is a side vertical section of the receptacle of FIG. 12A.

FIG. 13 is a vertical section of a portion of the embodiment of the receptacle of FIG. 12A. The FIG. 13 embodiment has a ridge 76 has been added in the bottom layer 86 of the wall portion 78 of the receptacle. In this preferred embodiment, the ridge 76 is located upon the downward side of the receptacle and helps assure mold seal-off. Sealing off the mold helps prevent sole material from the outsole molding process from accidentally spilling in over the bottom-end of the receptacle during production. (The receptacle and outsole are preferably molded ground-side up.) In addition, by adding ridge 76 to the basic design of FIG. 6, the structure of the FIG. 6 receptacle is strengthened, making it less susceptible to torques, distortions, or other forces. This results in better retention of the receptacle within the sole of athletic footwear.

Figure 14:
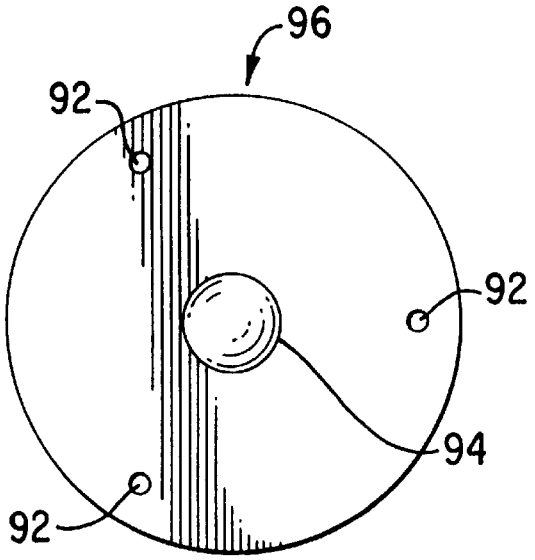
FIG. 14 is a bottom view of a cover for the FIG. 12A receptacle.

FIG. 14 shows a receptacle cover 96 having three holes 92 corresponding to the three openings 88 shown in FIG. 12. In preferred embodiments, the receptacle cover is designed to attach to and seal the top end of the receptacle 84 of FIG. 12A, so that during molding of a shoe sole around the receptacle, the sole material does not seep under the top edge of the receptacle and fill its cavity. In addition, at the center of the cover 96 is a dome 94. This dome hangs downward from the top of the receptacle, into the receptacle cavity for receiving a retaining member 20*b* (shown in FIG. 9A).

Figure 15:
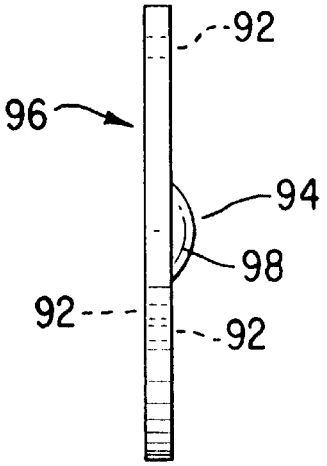
FIG. 15 a side view of FIG. 14 cover.

FIG. 15 shows a side view of the FIG. 14 cover, indicating the extent of the dome 94 with respect to the rest of the cover's 96 proportions. The dome forms a cavity 98 between a sole of a shoe and the top of the receptacle 84 (shown in FIG. 12A). In preferred embodiments, during manufacture of a shoe sole, in addition to sole material being molded around the receptacles, sole material is also allowed to fill in the cavity 98. Consequently, as a retaining member 20*b* (shown in FIG. 9A) is inserted into a proper receptacle, the insertion forces a compression of the dome which in turn compresses the sole material filling the dome. The dome 94 serves two purposes. First, when the retaining member 20*b* of traction gear is fully installed within a receptacle 84 (shown in FIG. 12A), the compression of the dome results in a downward pressure upon the extensions 22*b* from the dome trying to re-expand into its original shape. Second, when one tries to remove the traction gear from the receptacle 84, the re-expansion of the sole material helps push the retaining member away from the sole, thus aiding in the removal of attached gear.

In preferred embodiments, the extensions for the attachment system are molded using conventional molding processes. Preferably, the molding process uses mold components having expandable cavities, these cavities allowing for undercuts to be molded without the use of side actions or slides. The receptacle may be molded using conventional molding processes, where the receptacles are preferably produced on a horizontal or vertical press and, with the aid of precision mold design and building, are formed in a manner well-known in the art.

In preferred embodiments of the invention, during manufacture, the receptacle portion with the top cover attached is placed in an outsole mold, and the ground surface part of a shoe is then molded. The molding process is preferably one of injection or compression molding. The particular location of each receptacle within the mold depends on the intended use of the shoe and the design of the shoe's shape. During manufacture of the outsole of one embodiment of the invention, mold support-braces may be used to help ensure no deformation of the receptacles during the molding of the sole. Preferably, the support-braces are negatives of the receptacle's shape such that when a brace is inserted into a receptacle, the receptacle 84 and pin holes 88 (shown in FIG. 12A) are temporarily sealed off to prevent sole material from filling in the receptacle opening 40*b* and pin holes 88. These pins may also be used to help orient and position the receptacle so that sole material flows up to and not beyond the ridge 76 (shown in FIG. 13) that is visible on the ground side of the receptacle. Once the outsole is molded, a second material may be molded or cemented to the outsole, and also cemented to the upper portion of the shoe. In this embodiment, the outsole and second material combination form a completed sole having the embedded receptacles.

In some embodiments, the shoe sole may be formed of light-weight materials such is EVA or foam. In such embodiments, the sole material may be insufficiently strong to hold a receptacle firmly in place. Consequently, in preferred embodiments, a support plate may be added to the sole structure, wherein the receptacles are attached to the plate at the desired locations, and the sole is formed around the attached receptacles. Such plates may also be used for heel support for footwear having light-weight heels; similarly, for heel-plates, support-pins may also be used to help prevent heel receptacle deformation.

Figure 16:
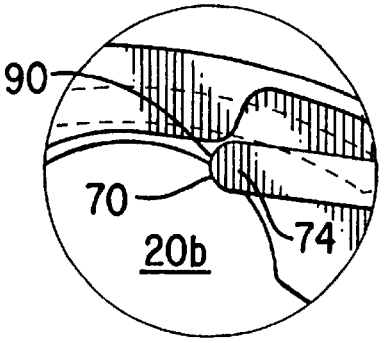
FIG. 16 is a partial view of a FIG. 9A cleat inserted into a FIG. 12A receptacle.

FIG. 16 is a partial view of a FIG. 9A cleat inserted into a FIG. 12A receptacle. Shown is a magnified view of the end portion 90 of a cantilevered finger 74 at rest in indentation 70 of retaining member 20*b*. As described hereinabove, after installation of a cleat into a receptacle, the torque required to dislodge the cantilevered finger 74 from the indentation 70 is much greater than that required during installation.

Figure 17:
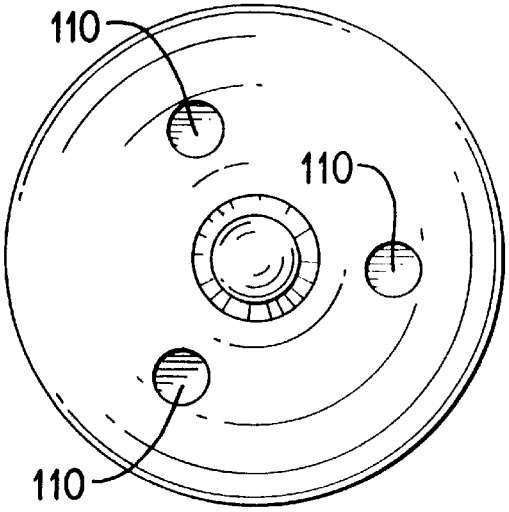
FIG. 17 is a bottom view of the FIG. 9A cleat.

FIG. 17, a bottom view of the FIG. 9A cleat, shows that in this embodiment of the invention, a three-pronged wrench is inserted into the three wrench holes 110 used to remove the cleat. Use of a three-wrench-hole design gives greater stability during insertion and removal of a cleat, and allows greater torque to be applied, without slipping out of the holes, during such insertion and removal.

Figure 18:
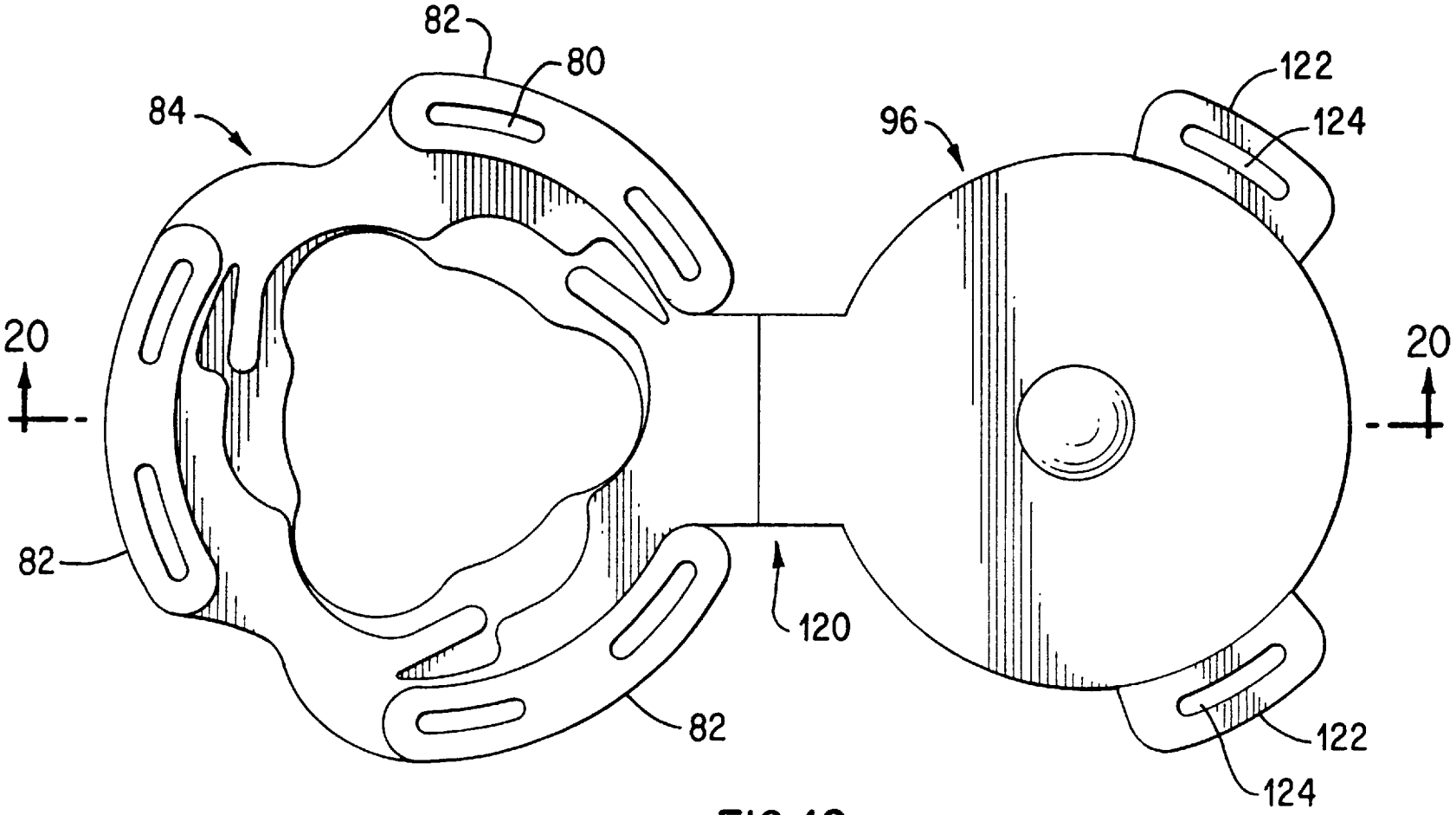
FIG. 18 is a to view of an unassembled receptacle for receiving the FIG. 9A cleat.

FIG. 18 is a top view of an alternate embodiment where a modified FIG. 14 cover is attached to the FIG. 12A receptacle through a flexible attachment region 120. In this embodiment, the receptacle 84 and cover 96 may be integrally formed of a single portion of production material, and simultaneously formed from a single mold. Before insertion of this embodiment of the receptacle into a shoe sole, the cover is flipped closed to cover the top of the receptacle. The FIG. 14 cover is modified to include two cover flanges 122 which, when the cover is closed, rest in-between two of the receptacle flanges 82. The cover flanges 122 also have slots 124, which in addition to the receptacle slots 80 described hereinabove, are used for mounting the FIG. 18 combined receptacle and cover to the underside of footwear.

Figure 19:
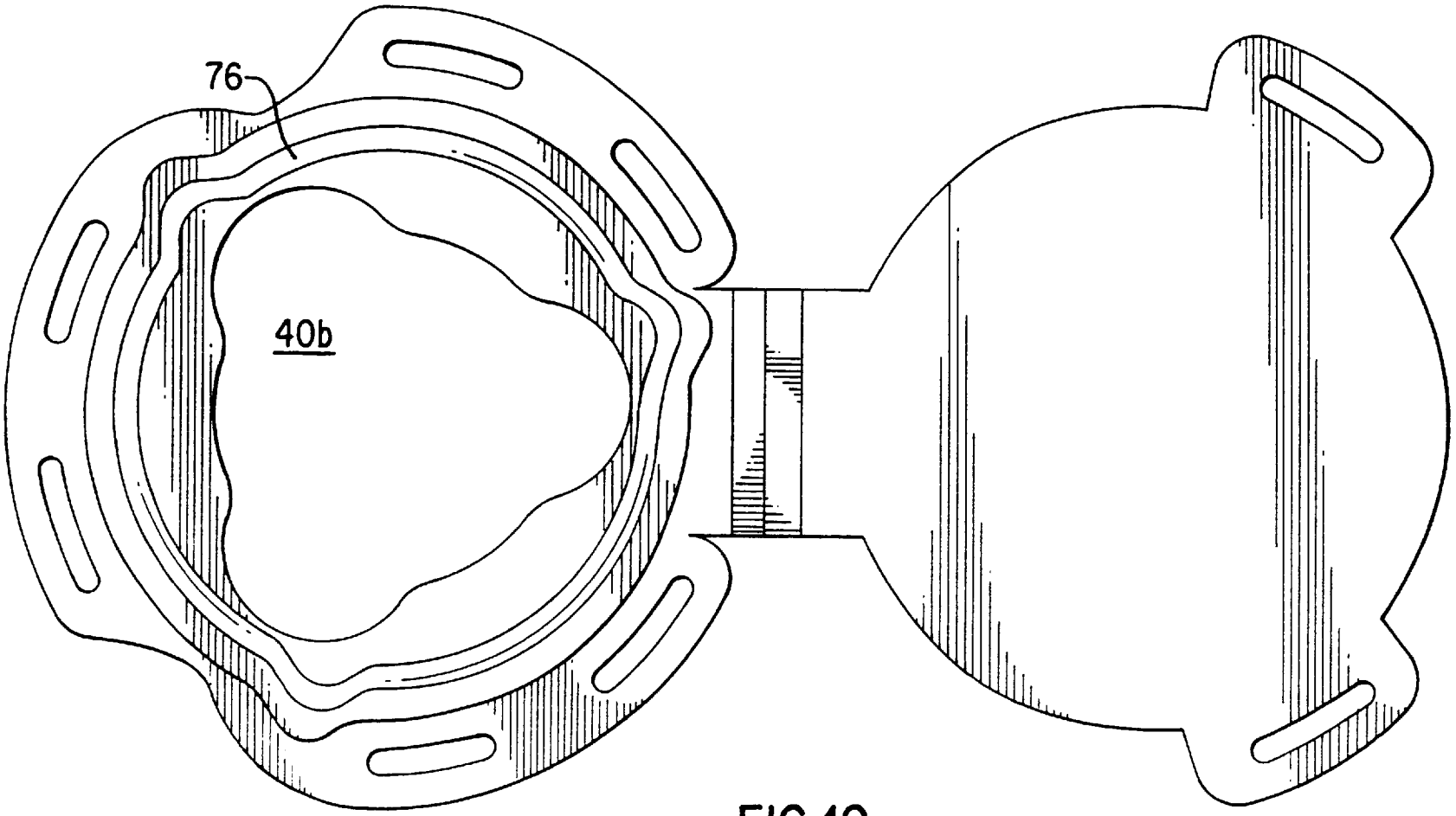
FIG. 19 is a bottom view of the FIG. 18 receptacle.

FIG. 19 is a bottom view of the FIG. 18 embodiment, showing the ridge 76 (see FIG. 13 hereinabove) which helps prevent sole material from the outsole molding process from accidentally spilling in over the bottom-end of the receptacle opening 40*b* with attached FIG. 14 cover having the features as disclosed hereinabove for FIG. 12A and FIG. 14.

Figure 20:
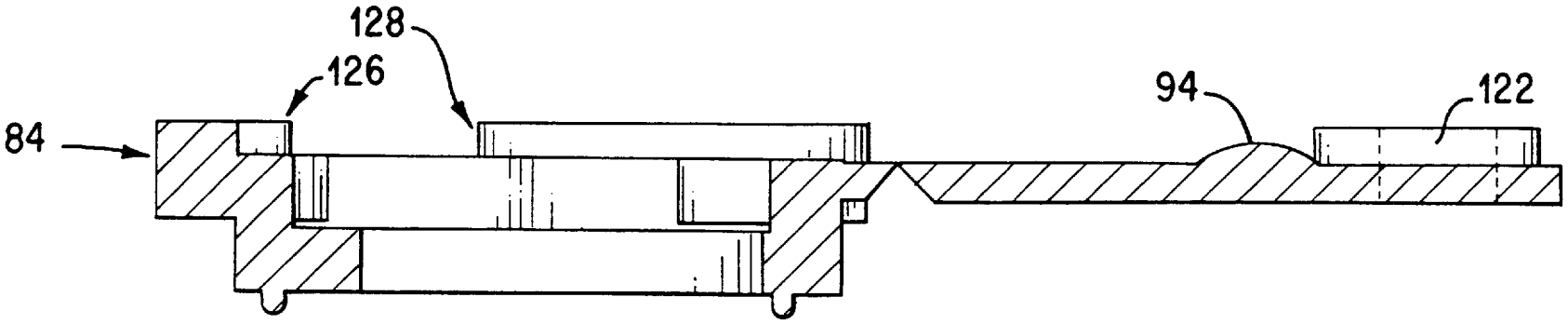
FIG. 20 is a section view of the FIG. 18 receptacle.

FIG. 20 is a top section view of FIG. 18, showing the relationship between the extent of the dome 94 and the receptacle 84. Also shown is the region defined by portions 126, 128 for receiving the cover flange 122 when the cover is closed over the receptacle 84.

The above description of the drawings provides details of several embodiments of the present invention. It is of course apparent that the present invention is not limited to the detailed description set forth above. Various changes and modifications of this invention as described will be apparent to those skilled in the art without departing from the spirit and scope of this invention as defined in the following claims.

What is claimed is:

1. A system for attaching a traction gear to the underside of footwear, comprising:

a retaining member having a vertical axis, and a bottom portion to which the traction gear is attached, and a top portion from which at least three extensions projects, each extension having a sloped portion which is not perpendicular to the vertical axis in all directions; and a receptacle for receiving the retaining member, the receptacle having a top end and a bottom end, a wall portion defining a cavity extending from the bottom end towards the top end, a ledge portion attached to the bottom end and extending into the cavity, the ledge portion being positioned so as to hold the plurality of extensions within the cavity, and a plurality of cantilevered fingers shaped and mounted within the cavity so as to engage the extensions of the retaining member and to resist dislodgment of the retaining member once the retaining member is installed;

wherein the retaining member may be removably attached to the receptacle.

2. A system according to claim 1, wherein the extensions are made substantially of thermoplastic.

3. A system according to claim 1, wherein the extensions are rounded.

4. A system according to claim 1, in which the receptacle includes means for preventing the retaining member from being turned more than about 60 degrees in a first direction.

5. A system according to claim 4, wherein the cantilevered fingers are shaped and mounted on the wall portion so as to permit turning the retaining member during installation with significantly less resistance than required for removal of the retaining member.

6. A system according to claim 5 wherein the ledge portion holding the extensions within the cavity includes platforms, parallel to the bottom end of the receptacle, for preventing downward movement of an installed cleat.

7. A system according to claim 6, wherein the extensions are made substantially of thermoplastic.

8. A system according to claim 1, wherein the plurality of extensions are within the same plane and spaced 120 degrees apart from each other.

9. A system for removably attaching a traction gear to the underside of footwear, comprising:

a retaining member having a vertical axis, a bottom portion to which the traction gear is attached, and a top portion from which three lobes project, wherein each lobe extends perpendicular to the vertical axis beyond the base; and a receptacle for receiving the retaining member, the receptacle having:

a top end and a bottom end, a wall portion defining a cavity extending from the bottom end towards the top end, a ledge portion attached to the bottom end and extending into the cavity, the ledge portion defining an aperture for receiving the lobes, the ledge portion including ledges for preventing downward movement of an installed cleat, bumps shaped and mounted on the wall portion as a means for preventing the cleat from being turned more than about 60 degrees during installation, a plurality of cantilevered fingers, wherein each finger is positioned perpendicularly to the vertical axis, and is shaped and mounted on the wall portion so as to engage the lobes of an installed cleat as a means for resisting turning the cleat back to its initial insertion point, and a lip at the bottom of the ledge portion, with which the outer edge of the top surface of traction gear forms an attachment less resistant to lateral forces.

10. A system according to claim 9 wherein each lobe is sloped so that upon installation of a lobe there is a gradual tightening of the fit of the extension into the receptacle's cavity.

11. A cleat comprising:

a spike for engaging the ground, the spike having a ground end and a top end;

a skirt near the top end of the spike, the skirt having an upper side and a convex lower side, wherein the spike protrudes from the lower side of the skirt, and the skirt extends transversely to the spike, the skirt having on its lower side receptacles for a cleat wrench; and a retaining means for removably attaching the cleat to a shoe, the retaining means having:

a base protruding approximately perpendicularly from the upper side of the skirt, the base having an upper end and a lower end, wherein the lower end is adjacent the skirt, the base having a vertical axis, and three extensions attached to the upper end of the base and extending beyond the base perpendicular to the base, wherein at least one of the extensions has a notch on its perimeter for engaging a projecting member in a cleat receptacle, and wherein the skirt's outer perimeter extends beyond the extensions, and wherein each of the three extensions are aligned along a radius extending from the base's vertical axis and is spaced 120 degrees from each of the other two extensions.

12. A cleat according to claim 11, wherein each of the extensions has a curved perimeter.

13. A cleat comprising:

a spike for engaging the ground, the spike having a ground end and a top end;

a skirt near the top end of the spike, the skirt having an upper side and a convex lower side, wherein the spike protrudes from the lower side of the skirt, and the skirt extends transversely to the spike, the skirt having on its lower side receptacles for a cleat wrench; and a retaining means for removably attaching the cleat to a shoe, the retaining means having:

a base protruding approximately perpendicularly from the upper side of the skirt, the base having an upper end and a lower end, wherein the lower end is adjacent the skirt, the base having a vertical axis, and three extensions attached to the upper end of the base and extending beyond the base perpendicular to the base, wherein each of the extensions has a semicircular perimeter, and wherein the skirt's outer perimeter extends beyond the extensions, and wherein each of the three extensions are aligned along a radius extending from the base's vertical axis and is spaced 120 degrees from each of the other two extensions and wherein at least one of the extensions has a notch on its perimeter for engaging a cantilevered finger in a cleat receptacle.

14. A cleat according to claim 13, wherein the extension having a notch has a tip, which is the point on the extension located furthest from the base's vertical axis, and wherein the notch is located approximately midway between the tip and the base.

15. A cleat according to claim 13, wherein each of the extensions has a notch on its perimeter for engaging a cantilevered finger in a cleat receptacle.

16. A cleat according to claim 15, wherein each extension has a tip, at a point on the extension located furthest from the base's vertical axis, and wherein the notch is located approximately midway between the tip and the base.

17. A cleat according to claim 16, wherein the height of the base of the retaining means is less than half of the radius of the skirt.

18. A cleat according to claim 11, wherein the height of the base of the retaining means is less than half of the radius of the skirt.

19. A cleat according to claim 11, wherein the skirt is formed of plastic and contains internal metal reinforcement.

20. A cleat according to claim 11, wherein the extensions are in the same plane and are positioned parallel to the skirt.

21. A cleat according to claim 11, wherein the gripping member and the retaining means are constructed entirely of metal.

22. A receptacle for receiving and holding a cleat to a sole of a shoe, the cleat having three extensions at its top end, the receptacle comprising:

a wall portion defining a cavity;

three stops, located within the cavity, for intercepting the extensions and preventing the cleat from being turned more than approximately 60 degrees in a first direction;

three cantilevered fingers, extending from the wall into the cavity, wherein the cantilevered fingers have a free end for engaging the extensions and resisting turning the cleat in a second direction for removing the cleat, wherein the cantilevered fingers extend from the wall angled towards the first direction; and a ledge located below the wall portion, wherein the ledge is positioned so as to prevent vertical movement of the extensions within the cavity, and wherein the ledge extends in a plane parallel to the plane into which the cantilevered fingers extend.

23. A receptacle according to claim 22, wherein the cantilevered fingers are in the same plane as the extensions.

24. A receptacle according to claim 23, wherein the cantilevered fingers are shaped and mounted on the wall portion so as to permit turning the cleat during installation with significantly less resistance than required for removal of the cleat.

25. A receptacle according to claim 24, wherein there is a lip formed at the bottom of the ledge means, against which the outer edge of the top surface of traction gear may overlap in a keyed fashion to form an attachment less resistant to lateral forces.

26. A cleat comprising:

a gripping member for engaging the ground; and a retaining means for removably attaching the cleat to a shoe, the retaining means having a base means attached to the top end of the gripping member, at least three extensions arranged in a curvilinear triangle shape, each extension attached to the base and extending perpendicular to the vertical axis beyond the base, and a perimeter on a first of the at least three extensions, wherein the perimeter includes an indentation into the surface of the extension.

27. A cleat according to claim 26, wherein the extensions are rounded in shape.

28. A cleat according to claim 26, wherein the perimeter of the extension is semicircular, and wherein the gripping member has a vertical axis, a ground end, a top end, and a skirt near the top end, and the cleat further comprises:

a first, second and third axis, the first axis being parallel to and offset from the vertical axis and defining the center of curvature for the semicircular perimeter, the second and third axis being mutually perpendicular as well as also being perpendicular to the first axis; and the indentation being positionally located near the intersection of the radius of curvature of the first of the at least three extensions with a line drawn from the center of curvature of the first extension, the line being drawn along the angle bisecting the second and the third axis.

29. A cleat according to claim 28, wherein the gripping member comprises a metal core surrounded by a plastic outer layer, and wherein the skirt is formed of plastic and contains internal metal reinforcement.

30. A system for removably attaching the cleat of claim 28 to the underside of footwear, the system comprising a receptacle for receiving the retaining means, the receptacle having:

a top end and a bottom end, a wall portion defining a cavity extending from the bottom end towards the top end, a ledge portion attached to the bottom end and extending into the cavity, the ledge portion defining an aperture for receiving the extensions, the ledge portion including ledges for preventing downward movement of an installed cleat, bumps shaped and mounted on the wall portion as a means for preventing the cleat from being turned more than about 60 degrees during installation, a plurality of cantilevered fingers, wherein each finger is positioned perpendicularly to the vertical axis, and is shaped and mounted on the wall portion so as to engage the extensions of an installed cleat as a means for resisting turning the cleat back to its initial insertion point; and a lip at the bottom of the ledge portion, with which the outer edge of the top surface of traction gear forms an attachment less resistant to lateral forces.

31. A system according to claim 30, wherein each extension is sloped so that upon installation of a lobe there is a gradual tightening of the fit of the extension into the cavity.

32. A system according to claim 31, wherein upon complete installation of the cleat, the end of a cantilevered finger is in communication with the indentation of an extension.

33. A system according to claim 32, wherein the receptacle further comprises a top-cover positioned at the top of the receptacle, the cover having a flat portion and a domed portion, wherein both the flat and the domed portions are concentrically arranged around the vertical axis, and the domed portion hangs down.

34. A sole of a shoe having a system of claim 30.

35. An athletic shoe sole having a receptacle for receiving a retaining means having at least three extensions, the receptacle comprising:

a top end and a bottom end, a wall portion defining a cavity extending from the bottom end towards the top end, a ledge portion attached to the bottom end and extending into the cavity, the ledge portion defining an aperture for receiving the extensions, the ledge portion including ledges for preventing downward movement of an installed retaining means, bumps shaped and mounted on the wall portion as a means for preventing the retaining means from being turned more than about 60 degrees during installation, at least three cantilevered fingers, wherein each finger is positioned perpendicularly to the vertical axis, and is shaped and mounted on the wall portion so as to engage the extensions of an installed retaining means as means for resisting turning the retaining means back to its initial insertion point;

a lip at the bottom of the ledge portion, with which the outer edge of the top surface of traction gear forms an attachment less resistant to lateral forces; and a cover having a contour and a top side, the cover being positioned at the top of the receptacle, wherein the cover is in communication with the sole of the shoe such that the sole's shape is mated with the cover's contour.

36. A sole of a shoe according to claim 35, wherein the retaining means is a cleat comprising:

a gripping member for engaging the ground, the gripping member having a vertical axis, a ground end, a top end, and a skirt near the top end;

an attachment means for removably attaching the cleat to a shoe, the attachment means having a base means attached to the top end of the gripping member, and a semicircular perimeter on a first of the at least three extensions, wherein the perimeter includes an indentation into the surface of the extension;

a first, second and third axis, the first axis being parallel to and offset from the vertical axis and defining the center of curvature for the semicircular perimeter, the second and third axis being mutually perpendicular as well as also being perpendicular to the first axis; and the indentation being positionally located near the intersection of the radius of curvature of the first of the at least three extensions with a line drawn from the center of curvature of the first extension, the line being drawn along the angle bisecting the second and the third axis;

wherein the at least three extensions are arranged in a curvilinear triangle shape, each extension attached to the base and extending perpendicular to the vertical axis beyond the base.

37. A method of installing a removable cleat to the sole of a shoe, the method consisting of the steps of:

providing a cleat having:

a gripping member for engaging the ground, the gripping member having a vertical axis, a ground end and a top end, a base attached to the top end of the gripping member, and a plurality of extensions attached to the base and extending perpendicular to the vertical axis beyond the base;

providing a receptacle for receiving and holding the cleat, the receptacle being mounted in the sole of a shoe, the receptacle having:

a top end and a bottom end;

a wall portion defining a cavity, a ledge means located below the wall portion, wherein the ledge means defines an aperture into which the cleat is inserted upon installation, and is configured so as to hold the extensions within the cavity, a dome at the top end of the receptacle, so that installing the cleat compresses the dome, and during removal of the cleat, the dome expands and helps eject the cleat from the receptacle;

means for preventing the cleat, when inserted, from being turned more than about 60 degrees in a first direction, and means for resisting turning the cleat in a second direction for removing the cleat;

inserting the cleat's extensions into the receptacle's cavity; and turning the cleat until the cleat reaches a locked position.

* * * * *